United States Patent [19]

Shaw

[11] 3,934,289

[45] Jan. 27, 1976

[54] MARINE FLUID TRANSFER APPARATUS

[75] Inventor: Clarence W. Shaw, Metairie, La.

[73] Assignee: J. Ray McDermott & Co., Inc., New Orleans, La.

[22] Filed: Jan. 6, 1975

[21] Appl. No.: 538,951

[52] U.S. Cl. ..... 9/8 P; 9/88

[51] Int. Cl.[2] ..... B63B 21/52

[58] Field of Search..... 114/.5 R, .5 D, 49, 53; 9/8 P, 8.5; 61/67, 68, 69 R, 81, 83; 166/.5

[56] References Cited

UNITED STATES PATENTS

| | | | |
|---|---|---|---|
| 3,360,810 | 1/1968 | Busking | 9/8 P |
| 3,372,409 | 3/1968 | Manning | 9/8 P |
| 3,407,416 | 10/1968 | Brickhouse | 9/8 P |
| 3,421,579 | 1/1969 | Manning | 166/.5 |
| 3,434,442 | 3/1969 | Manning | 114/.5 D |
| 3,512,583 | 5/1970 | James | 61/69 R |
| 3,525,388 | 8/1970 | McClintock | 166/.5 |
| 3,789,921 | 2/1974 | De Chassy et al. | 166/.5 |
| 3,853,183 | 12/1974 | Downs | 166/.5 |

*Primary Examiner*—Trygve M. Blix
*Assistant Examiner*—Jesus D. Sotelo

[57] ABSTRACT

An offshore marine terminal for mooring a tanker and transferring fluids between the tanker and an underwater manifold. The offshore marine terminal comprises a buoyant member having a first end extending above the surface of the water and a second end submerged and extending beneath the water, a bathyal service chamber on the second end of the member defining an underwater habitat suitable for maintaining humans in an artificial atmosphere, an upper buoyancy and ballast chamber to selectively change the buoyancy of the member from a first lowered condition which has the bathyal service chamber positioned around the manifold to a second elevated position which has the chamber disposed above the manifold, and flow lines to transport the fluid through the chamber from the manifold to the tanker. The tanker may be moored to the terminal by a swivel mooring connection that is rotatable about the buoyant member. The terminal may be secured to the ocean bottom in a flexible manner such that a fulcrum point is created allowing the terminal to tilt.

15 Claims, 3 Drawing Figures

MARINE FLUID TRANSFER APPARATUS

FIELD OF THE INVENTION

This invention relates to offshore mooring terminals for the mooring of tank ships and the transfer of fluids between underwater pipelines and tank ships. More specifically, the invention relates to an anchored offshore terminal having an underwater work habitat associated therewith.

BACKGROUND OF THE INVENTION

Current trends in offshore oil and gas procurement indicate that the drilling and working of underwater mineral deposits will be increasingly important in providing the world's oil requirements. Sites for the production of underwater mineral deposits are being found at locations further and further from shore. The submerged wells in offshore waters are often times at such great distances from shore that it is not feasible to transport the crude oil directly from the well site to onshore processing facilities by a pipeline. In such situations, accumulated oil is stored at the well site. Often, the storage of oil at the well site is accomplished by utilizing a submerged storage tank, moored in the bottom of the body of water. It becomes necessary to transfer the stored crude oil from a location under the surface of the water to a tank ship for transporting the crude oil to onshore processing facilities. It is desirable to have a device for ship mooring and fluid transfer between tank storage and tank ship.

Requirements for large quantities of crude oil at the lowest possible price has brought about changes in the manner of transporting oil between continents. In prevalent use for the transporting of oil are large supertankers. Supertankers due to their large size and deep draft are not able to dock at many ports. Those deep harbor ports are very crowded, and tankers often must wait long periods of time before loading or unloading its fluid cargo. To alleviate the problems associated with supertanker transporting of fluid cargo, it is necessary for the supertankers to station themselves some distance from shore to receive or deliver cargo via underwater pipelines. To enable the supertankers to load and unload at these offshore positions, devices are required which moor the ship and provide the coupling link between the supertanker and the underwater pipeline.

Problems have been encountered in prior art offshore terminals where it is anchored and held rigid permitting very little movement of the terminal in response to wind, waves and currents. In addition for most offshore terminals, flexible hose are utilized to connect the underwater pipeline outlet with the fluid conduit connectors at the terminal. As a result, any twisting movement of the offshore terminal will place great stress on the hoses requiring replacement by procedures which are both time consuming and expensive.

Additional problems encountered with prior offshore terminals have concerned the flow line from the underwater pipeline to the surface of the water. Being very long, it is subjected to considerable force from undersea currents. In addition, drifting of the tanker will change the position of the tanker in respect to the flow line connecting to the tanker. Such a change in tanker position is reflected in a change in the required length of connecting flow line. Extreme changes of position of this sort put great stress on the connecting flow line which could possibly cause a rupture of the line. Excessive slack to allow for movement may allow the tanker to overrun and damage the hose.

Further, it is very necessary that the moored tanker be able to rotate about the terminal. A tanker when empty must be able to align itself into the wind and when loaded must be able to head into the current. In any other attitude, the moored tanker is unstable, and a danger of collision between the tanker and terminal exists.

There is accordingly provided by this invention a novel offshore marine terminal, for mooring tankers and transferring fluids between a tanker and an underwater pipeline, which includes a bathyal service chamber for creating an underwater work habitat at the mooring site which, when the terminal is lowered over an underwater manifold, can be used to make original anchor hookups and any subsequent repairs.

There is provided an offshore marine terminal which is suitable for deep, rough water locations and which has reduced surface buoyancy and short anchor lines.

There is further provided by the instant offshore marine terminal a configuration which reduces surface slack in the floating connection hose thereby preventing damage to the hose from overrun as the tanker moves about the mooring point.

There is also provided in accordance with this invention an offshore marine terminal which is easily maintained and permits repair or replacement of parts to be done more quickly.

There is yet further provided an offshore marine terminal in which the structure readily complies with tanker movement due to wind, waves and currents without developing high stresses on the mooring terminals or fluid connection hoses.

The novel offshore marine terminal in accordance with this invention has a buoyant member which floats in a body of water. A first end extends above the surface of the water, and a second end is submerged and extends beneath the water. A bathyal service chamber is on the second end of the member. The bathyal service chamber defines an underwater habitat which is suitable for maintaining humans in an artificial atmosphere. The terminal includes means to selectively change the buoyancy of the member allowing it to move from the first lowered condition to a second elevated position.

The member, when in the lowered position, has the bathyal service chamber positioned around an undersea manifold, pipeline, storage facility or the like. When the member is in the elevated position, the bathyal service chamber is disposed above the undersea manifold.

Flow lines to transport fluid between the manifold and the vessel extend through the bathyal service chamber. Also, short anchor lines secured to anchors can be used to secure the buoyant member to the subsea floor. The anchor lines would attach to the buoyant member at a position which would permit lateral movement of the first end of the member in response to movement of the surface vessel.

It is to be understood that, as used herein, the term "fluid" is intended to mean any liquid, gas or fluid slurry with solid particles suspended therein.

DESCRIPTION OF THE PREFERRED EMBODIMENTS

Figure 1:
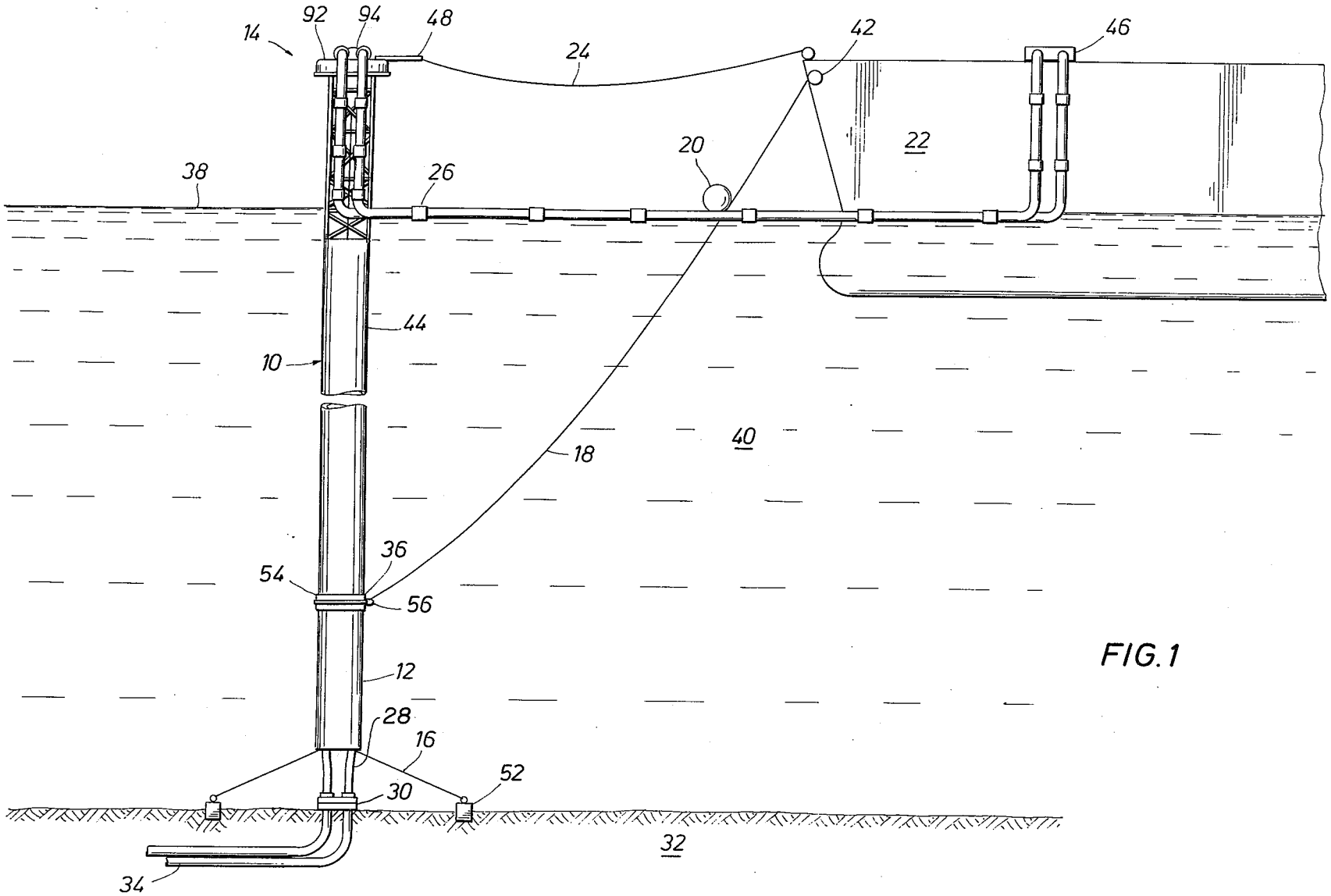
FIG. 1 is a side elevation view of the offshore marine terminal to which a tanker is moored, illustrative of the invention.

With reference to FIG. 1, there is illustrated a novel offshore marine terminal in accordance with a preferred embodiment of this invention. Offshore terminal 10 is shown mooring tanker 22 at an offshore location in a body of water 40. The surface of this body of water is designated by the numeral 38, and the water floor is designated by the numeral 32.

The offshore terminal 10 includes a vertical standing, buoyant member 44 atop a bathyal service chamber 12. Anchor lines 16 secure the structure to the water floor 32. A mooring line 18 connects to the offshore terminal 10 by a swivel connection 36 which is attached circumjacent member 44. The mooring line 18 is connected to a floating buoy 20 at the surface 38. When a ship is not moored at the location, the floating buoy 20 keeps the upper end of mooring line 18 at the surface 38. Buoyant member 44 extends above the water surface 38, and affixed to the top of member 44 is a rotary swivel connection loading buoy 14. To the swivel connection loading buoy 14, there is connected a floating hose 26. Hose 26 permits fluid communication to a tanker manifold 46. An index boom 48 has a position index line 24 extending out and attached to the tanker 22. Flexible hoses 28 provide fluid communication from the underwater manifold 30 which is being fed by pipeline 34.

Member 44 is a substantially rigid member having a positive buoyancy. Member 44 has a cylindrically shaped external surface made of a material such as steel. Internally, member 44 may have either one pipe or several parallel pipes extending throughout its length. A buoyancy chamber 62 is formed within member 44 to permit selectively changing terminal 10 buoyancy by flooding the chamber to lower terminal 10 position in the water or blowing the water out to raise terminal 10 position in the water.

Formed at the submerged end of buoyant member 44 is an open-bottom bathyal service chamber 12. Bathyal service chamber 12 has winch moorings 50 just inside its open bottom to provide connection points for anchor lines 16. Bathyal service chamber 12 has an opening diameter larger than the outside diameter of underwater manifold 30 so that the opening can be positioned over the manifold 30. To create a dry work habitat, bathyal service chamber 12 can be purged to ambient pressure by the introduction of compressed air into the interior of the chamber. Further details of member 44 and bathyal service chamber 12 will be discussed hereinafter in reference to FIG. 2 and FIG. 3 and the embodiments illustrated therein.

Mounted atop member 44 is a swivel connection loading buoy 14 which is rotatable about an axis which is at the center of member 44. Swivel connection loading buoy 14 generally comprises a rotary support structure 92 and a swivel coupling 94 interconnecting floating hoses 26 and flow lines 58 which are internal to member 44. The attachment of swivel connection loading buoy 14 to member 44 is made directly to rotary support structure 92. The swivel connection loading buoy 14 has index boom 48 extending from it. An index line 24, connected to index boom 48 and tanker 22, monitors the distance between the terminal 10 and tanker 22. As tanker 22 moves about terminal 10 in response to wind and water currents, tension on floating hoses 26 will cause swivel connection loading buoy 14 to rotate. This rotation of swivel connection loading buoy 14 prevents floating hoses 26 from wrapping around terminal 10 or becoming kinked. As tanker 22 moves inward radially, the swivel connection loading buoy 14 takes up the slack in floating hoses 26.

For a more detailed description of swivel connection loading buoy 14, the reader may refer to the systems disclosed in U.S. Pat. No. 3,365,734, issued Jan. 30, 1968, to Warren A Petrie and George R. Smith entitled "Buoy For Transferring Fluent Materials"; and U.S. Pat. No. 3,414,918, issued Dec. 10, 1968, to Warren A. Petrie and George R. Smith entitled "Apparatus For Transferring Fluent Materials", both of which are incorporated herein by reference. The present application is assigned to the same assignee as the above identified patents.

Swivel mooring connection 36 secures mooring line 18 to the offshore terminal 10. The swivel mooring connection 36 includes a bearing frame 54 and a ring 56. Bearing frame 54 is placed around the periphery of buoyant member 44 near the end to which service chamber 12 is affixed. The bearing frame 54 creates a path for rotation around the tower 44 with the axis of rotation being the longitudinal axis of tower 44. Ring 56 is slidably mounted in the fixed bearing frame 54 and follows the circular track created by bearing frame 54. The bearing surfaces of bearing frame 54 can be of a non-corrosive material such as phenolic; while bearing races can be stainless steel. As the direction of the wind and current varies, a tangential force component will be developed at the swivel mooring connection 36 through mooring line 18. The force will cause the ring 56 to rotate about the vertical axis of the terminal 10. This rotational movement of swivel mooring connection 36 permits the tanker 22 to move rotationally about the terminal 10 in response to wind and currents acting upon the tanker 22.

Figure 2:
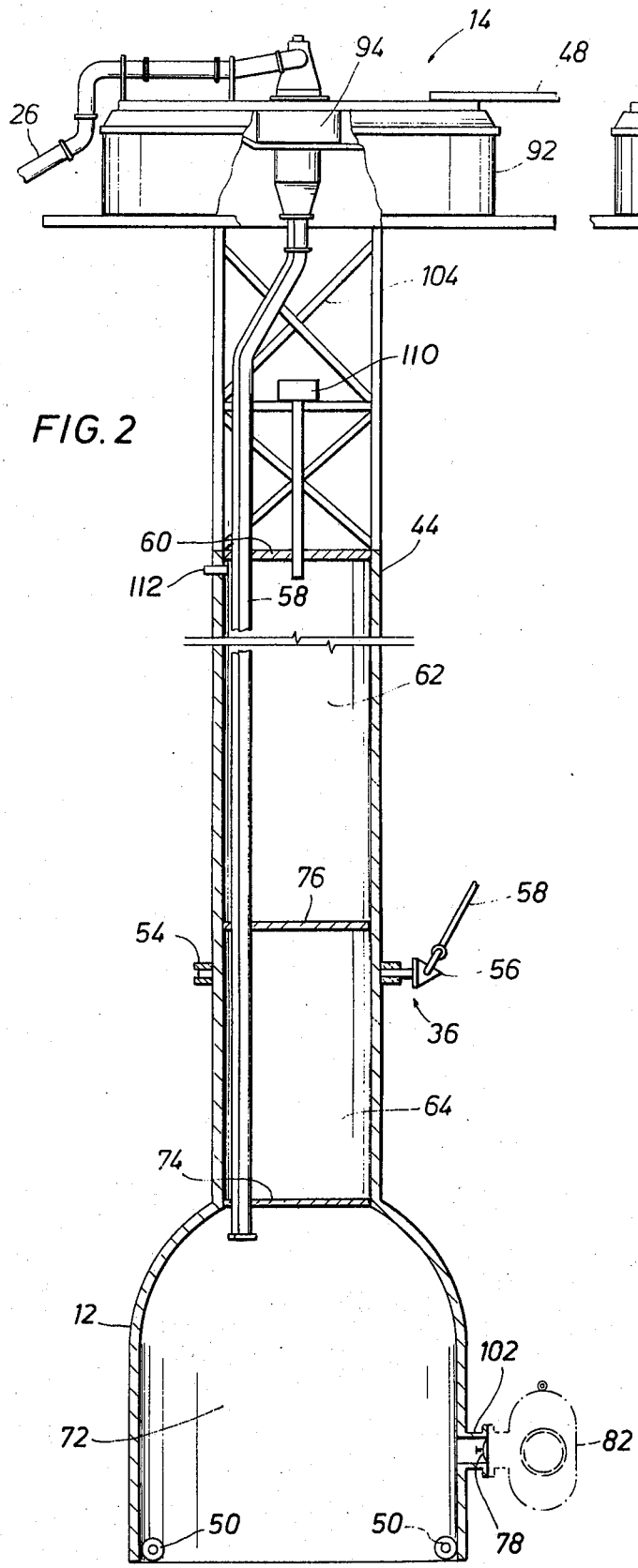
FIG. 2 is a detailed cross-sectional view of a specific embodiment of the invention in which the buoyant member or chamber has a passageway in its side for coupling to an external diver transport device.

Referring to FIG. 2, there is illustrated a detailed cross-sectional view of a specific embodiment of the present invention. Specifically, there is depicted buoyant member 44 and bathyal service chamber 12. Disposed within and running longitudinally through buoyant member 44 are flow lines 58. Flow lines 58 terminate just inside service chamber 12 with flanged couplings at the ends to which flexible hoses 28 are attached. The upper ends of flow lines 58 connect to the swivel connection loading buoy 14. Barrier plate 74 includes service chamber hatch 70 and forms a dividing wall between member 44 and service chamber 12. Upper bulkhead 60 and lower bulkhead 76 are placed in the interior of member 44 at a fixed distance apart to form buoyancy chamber 62. Buoyancy chamber 62 can be flooded through vent 112 to give terminal 10 a negative buoyancy or filled with air from compressor 110 to give terminal 10 a positive buoyancy. Lower bulkhead 76 is above barrier plate 74 and separated therefrom by a fixed distance thereby defining lower chamber 64 which is vented to sea pressure. Through the wall of bathyal service chamber 12, there is a docking port 102 which is arranged to receive submarine diving bell 82. Submarine diving bell 82 transports divers to docking port 102 where it docks, and divers enter the dry habitat 72 through escape hatch 78. Swivel mooring connection 36 is shown in place circumjacent member 44 and above service chamber 12. Swivel connection loading buoy 14 is shown with index boom 48 and flexible hoses 26 extending from it. Swivel coupling 94 extends through an opening in the center of rotary support structure 92 and inter-connects floating hoses 26 and flow lines 58. When flexible hoses 28 are coupled to the lower ends of flow lines 58, a continuous path for fluid transfer is established.

Buoyant member 44 is fully enclosed in the area which would be beneath the surface of the water when terminal 10 is in its lowered position. The portion of member 44 which extends above the water surface, even when terminal 10 is in the lowered position, may be constructed as skeleton structure 104.

Figure 3:
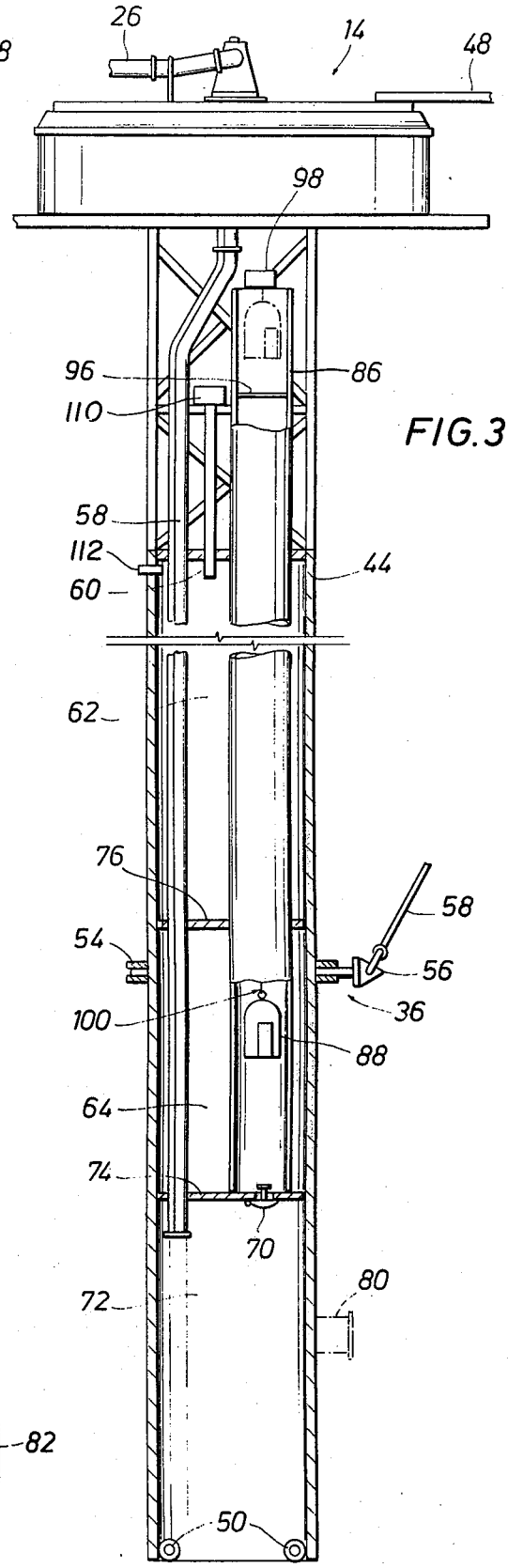
FIG. 3 is a detailed cross-sectional view of another embodiment of the invention wherein a personnel lift and transport tube are inside the buoyant member.

Referring to FIG. 3, there is illustrated a detailed cross-sectional view of another embodiment of the invention. Reference numerals are the same as used in FIG. 2 for like elements. The embodiment in FIG. 3 differs from that of FIG. 2 in the manner in which divers are transported to service chamber 12. Disposed within member 44, running longitudinally therewith, is a personnel lift transport tube 86. Personnel lift transport tube 86 extends from service chamber 12 to personnel transport entrance 96. Hatch door 70 seals the lower end of personnel lift transport tube 86. Personnel lift 88 travels vertically in transport tube 86 supported by lift cable 100. Personnel lift 88 is moved between service chamber 12 and personnel transport entrance 96 by cable-take-up winch 98. Divers enter personnel lift 88 by way of personnel transport entrance 96. Personnel lift 88 may either be a pressurized or a non-pressurized cabin. Winch 98 lowers personnel lift 88 to the bottom of personnel lift transport tube 86. Divers leave personnel lift 88 and enter service chamber 12 through hatch door 70. Personnel lift 88 may include a decompression chamber if desired. An escape hatch 80 is also provided.

It is to be understood that, at locations where only shallow water is encountered and the divers are subjected to little pressure, divers may swim down unaided by any transport mechanism. Thus in some applications, the transport mechanisms described herein as a part of the preferred embodiments may be unnecessary and accordingly eliminated from the structure.

In use, the offshore terminal 10 floats in the water anchored by anchor lines 16. The buoyancy chamber 62 has some amount of water and air present, the exact amount depending upon the depth at which the terminal 10 is desired to be positioned and the amount of anchor line tension desired. The bottom of bathyal service chamber 12 is positioned immediately above and some distance from underwater manifold 30. At the time of initial placement of the offshore terminal 10 or during subsequent times to repair the flexible flow lines 28, the buoyancy of member 44 may be altered allowing the terminal 10 to sink to the sea floor 32 with service chamber 12 enclosing underwater manifold 30. Service chamber 12 can be purged thereby creating a dry habitat 72. Inside the habitat 72, work personnel can connect and work on flexible hoses 28. After the connection of flexible hoses 28 has been completed, the buoyancy chamber 62 is cleared of water giving the terminal 10 a positive buoyancy again. The terminal 10 rises in the water until the anchor lines 16 are fully extended. Also, service chamber 12 can be allowed to fill with water after positioning is completed.

Anchor lines 16 attached to chamber 12 by winch moorings 50 can be a chain linkage arrangement, cable or other suitable restraining members. The lengths of anchor lines 16 are fixed such that flexible hoses 28 are extended with only a small amount of slack. Anchor lines 16 are positioned at the locations on the terminal 10 as shown to prevent extreme lateral movements which would put excessive stress on flexible hoses 28. The position of anchor lines 16 is further restricted to a point below the center of buoyancy. Due to this positioning of anchor lines 16, a fulcrum point is created allowing the terminal 10 to tilt as force is applied to it through mooring line 18. Tension applied on floating hose 26 will also cause terminal 10 to assume a tilted position in the water. The tilting of terminal 10, yielding to surges of tanker 22 as it makes excursions about its mooring, has the effect of creating additional slack in floating hoses 26. The additional slack created by the tilting of terminal 10 makes it unnecessary to have excessive slack in floating hoses 26 which would allow the possible overrun of the tanker 22 and result in damage to floating hoses 26.

Fluid transfer between underwater manifold 30 and the tanker 22 takes place after the tanker 22 is moored and with the terminal 10 raised off the sea floor 32. For example, fluid is transferred from storage tanks onboard tanker 22 through floating hose 26 connected to tanker manifold 46. The floating hose 26 is also connected to swivel top 14 atop the offshore terminal 10. It is to be noted that floating hose 26 may be only a single hose or several. Swivel top 14 is in fluid communication with the flow line 58 which extends longitudinally within member 44. Again, it is pointed out that flow line 58 may comprise one or more than one pipe. Flow line 58 terminates just inside service chamber 12 and feeds a short flexible hose 28. The number of flexible flow lines 28 will generally correspond to the number of flow lines 58 within buoyant member 44. It would be possible, however, to use a Y connection thereby feeding only one flexible hose from two internal flow lines. Flexible hose 28 connects to underwater manifold 30 which thence leads into underwater pipeline 34 for carrying the fluid shoreward or to other destinations as may be required. Of course, the fluid can be passed through the system in the opposite direction to that just described. It is to be pointed out that while this specific fluid transfer line arrangement is shown as the preferred embodiment, other suitable fluid transfer line arrangements can be used.

Although the above description is directed to the preferred embodiment of the invention, it is noted that other variations and modifications will be apparent to those skilled in the art and, therefore, may be made without departing from the spirit and scope of the present disclosure.

What is claimed is:

1. An offshore marine terminal for mooring a tanker vessel and transferring fluids between the tanker and an underwater manifold, which comprises:

a buoyant member having a first end extending above the surface of the water and a second end submerged and extending beneath the water;

a bathyal service chamber on said second end of said member defining an underwater habitat suitable for maintaining humans in an artificial atmosphere;

means to selectively change the buoyancy of said member from a first lowered condition, in which said bathyal service chamber is positioned around said manifold to provide access to said manifold in a dry environment, to a second elevated positioned in which said member is disposed above said manifold; and flow lines to transport the fluid, through said chamber, between the manifold and the vessel.

2. The offshore marine terminal of claim 1, which further comprises:

anchors for securing said member of the subsea floor; and anchor lines secured to said anchors and attached to said member at a position permitting lateral movement of the first end of said member in response to movement of said vessel.

3. The offshore marine terminal of claim 2, wherein said anchor lines are positioned to create a fulcrum point allowing said member to tilt in the water.

4. The offshore marine terminal of claim 2, wherein said anchor lines are attached below the center of gravity of the terminal.

5. The offshore marine terminal of claim 2, including flexible couplings between said manifold and said flow lines.

6. The offshore marine terminal of claim 1, which further comprises:

swivel connection fluid transfer means, mounted on the first end of said member, for maintaining fluid communication between said flow lines and the vessel.

7. The offshore marine terminal of claim 1, which further comprises:

a buoyancy chamber, proximate said member, which is selectively ballasted and deballasted of seawater by compressed air.

8. The offshore marine terminal of claim 1, which further comprises:

swivel mooring means circumjacent the lower portion of said member for providing a rotatable mooring for tankers.

9. The offshore marine terminal of claim 8, wherein said swivel mooring means is free to swivel 360° around the vertical axis which corresponds to the center line of said member.

10. The offshore marine terminal of claim 8, which further comprises:

a mooring line which moors the vessel to said swivel mooring means; and a floating hose interconnecting a tanker manifold and said swivel connection fluid transfer means.

11. The offshore marine terminal of claim 1, wherein said bathyal service chamber includes a docking port proximate thereto for receiving a submarine diving bell to provide access to said chamber from said diving bell.

12. The offshore marine terminal of claim 1, which futher comprises:

means disposed within said member for transporting personnel to and from said bathyal service chamber.

13. The offshore marine terminal of claim 12, wherein said means for transporting personnel comprises:

a hollow, cylindrical tubular member positioned longitudinally within said member, said tubular member extending from said bathyal service chamber to a point just below said swivel connection fluid transfer means;

a capsule placed within the tubular member to carry personnel;

a cable attached to said capsule providing support thereto; and means for moving said capsule by taking up or extending said cable.

14. The offshore marine terminal of claim 11, wherein said means for moving is a winch.

15. An offshore marine terminal for mooring a tanker vessel and transferring fluids between the tanker and an underwater manifold, which comprises:

a buoyant member having a first end extending above the surface of the water and a second end submerged and extending beneath the water;

a bathyal service chamber on said second end of said member defining an underwater habitat suitable for maintaining humans in an artificial atmosphere;

means to selectively change the buoyancy of said member from a first lowered condition, in which said bathyal service chamber is positioned around said manifold to provide access to said manifold in a dry environment, to a second elevated position in which said member is disposed above said manifold;

flow lines to transport the fluid, through said chamber, from the manifold;

anchors for securing said member to the subsea floor;

anchor lines secured to said anchors and attached to said member at a position permitting lateral movement of the first end of said member in response to movement of said vessel; and swivel connection fluid transfer means, mounted on the first end of said member, for maintaining fluid communication between said flow lines and the vessel.

* * * * *